US010568395B2

(12) United States Patent
Hayashi

(10) Patent No.: US 10,568,395 B2
(45) Date of Patent: Feb. 25, 2020

(54) UPPER STRUCTURE OF FEMALE SNAP BUTTON, FEMALE SNAP BUTTON AND METHOD OF ATTACHING FEMALE SNAP BUTTON TO TEXTURE

(71) Applicant: YKK Corporation, Tokyo (JP)

(72) Inventor: Daisuke Hayashi, Tokyo (JP)

(73) Assignee: YKK Corporation (JP)

( * ) Notice: Subject to any disclaimer, the term of this patent is extended or adjusted under 35 U.S.C. 154(b) by 100 days.

(21) Appl. No.: 15/528,586

(22) PCT Filed: Dec. 1, 2014

(86) PCT No.: PCT/JP2014/081782
§ 371 (c)(1),
(2) Date: May 22, 2017

(87) PCT Pub. No.: WO2016/088182
PCT Pub. Date: Jun. 9, 2016

(65) Prior Publication Data

US 2018/0242696 A1 Aug. 30, 2018

(51) Int. Cl.
*A44B 17/00* (2006.01)

(52) U.S. Cl.
CPC ..... *A44B 17/0076* (2013.01); *A44B 17/0041* (2013.01)

(58) Field of Classification Search
CPC .. A44B 17/0076; A44B 17/0041; A44B 17/00
See application file for complete search history.

(56) References Cited

U.S. PATENT DOCUMENTS 1,831,202 A 11/1931 Simons
5,375,302 A 12/1994 Takamura
5,940,940 A * 8/1999 Tanikoshi ..... A44B 17/0082 24/108

(Continued)

FOREIGN PATENT DOCUMENTS

CN 102014684 A 4/2011
EP 1584253 A2 10/2005

(Continued)

OTHER PUBLICATIONS

International Search Report, PCT Application No. PCT/JP2014/081782, dated Feb. 24, 2015.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

An upper structure of a female snap button includes a post holding member for holding a post of a male snap button, and a receiving member for receiving the post holding member. The receiving member includes a surrounding wall that extends in an up and down direction to surround the post holding member, a bottom portion that is coupled to a lower end of the surrounding wall and provided inward of the surrounding wall, and a peripheral portion that is coupled to an upper end of the surrounding wall and provided outward of the surrounding wall. An opening is defined by a rim between the upper end of the surrounding wall and the peripheral portion.

19 Claims, 14 Drawing Sheets

(56) References Cited

U.S. PATENT DOCUMENTS

| | | | | |
|---|---|---|---|---|
| 6,170,135 | B1 * | 1/2001 | Pferdehirt | A44B 17/007 24/687 |
| 9,839,263 | B2 * | 12/2017 | Villa | A44B 17/0023 |
| 9,986,792 | B2 * | 6/2018 | Chen | A44B 17/0023 |
| 2010/0139058 | A1 * | 6/2010 | Pferdehirt | A44B 17/0023 24/697.1 |
| 2011/0113600 | A1 * | 5/2011 | Hasegawa | A44B 17/0023 24/594.11 |
| 2012/0011691 | A1 * | 1/2012 | Hasegawa | A44B 1/44 29/33 R |
| 2014/0109352 | A1 * | 4/2014 | Violato | A44B 17/0076 24/303 |
| 2014/0137373 | A1 * | 5/2014 | Villa | A44B 17/0023 24/108 |
| 2014/0325797 | A1 * | 11/2014 | Hasegawa | A44B 17/0076 24/108 |
| 2015/0052666 | A1 * | 2/2015 | Kanazawa | A41H 37/04 2/265 |
| 2015/0096156 | A1 * | 4/2015 | Brezzi | A44B 17/0041 24/662 |
| 2018/0055151 | A1 * | 3/2018 | Hayashi | A44B 1/28 |

FOREIGN PATENT DOCUMENTS

| | | | |
|---|---|---|---|
| JP | 36-025004 | Y1 | 9/1961 |
| JP | 44-024643 | Y1 | 10/1969 |
| JP | 06-041514 | | 6/1994 |
| WO | 2008/038743 | A1 | 4/2008 |
| WO | 2012/029119 | A1 | 3/2012 |

OTHER PUBLICATIONS

International Preliminary Report on Patentability, PCT Application No. PCT/JP2014/081782, dated Jun. 15, 2017.

Supplementary European Search Report, European Patent Application No. 14907406.4, dated May 4, 2018.

Office Action, Chinese Patent Application No. 201480083787.0, dated May 15, 2019, 13 pages.

* cited by examiner

UPPER STRUCTURE OF FEMALE SNAP BUTTON, FEMALE SNAP BUTTON AND METHOD OF ATTACHING FEMALE SNAP BUTTON TO TEXTURE

This application is a national stage application of PCT/JP2014/081782, which is incorporated herein by reference.

TECHNICAL FIELD

The present disclosure is related to an upper structure of a female snap button, a female snap button, and a method of attaching a female snap button to a texture.

BACKGROUND ART

The patent document 1 discloses a female part provided with a first housing region (15) and additionally a second housing region (16).

CITATION LIST

Patent Literature

PTL 1 International Publication No. 2008/038743

SUMMARY OF INVENTION

Technical Problem

A metal cover (21, 26, 29) shown in FIGS. 2-4 of the patent document 1 requires a swaging step to confine a main body (10). Through the swaging step, the main body may be securely confined inside of the cover, thereby preventing the main body from being detached from the cover. The present inventor has newly recognized a technical problem that such approach may involve a lowered production efficiency of female snap buttons.

Solution to Problem

An upper structure of a female snap button according to an aspect of the present invention comprises: a post holding member for holding a post of a male snap button; and a receiving member for receiving the post holding member, wherein the receiving member comprises: a surrounding wall that extends in an up and down direction to surround the post holding member; a bottom portion that is coupled to a lower end of the surrounding wall and provided inward of the surrounding wall; and a peripheral portion that is coupled to an upper end of the surrounding wall and provided outward of the surrounding wall, and wherein an opening is defined by a rim between the upper end of the surrounding wall and the peripheral portion.

In some embodiments, the post holding member comprises: a tube that extends in the up and down direction; one or more locking portions for locking the post; and a bottom portion that is coupled to a lower end of the tube and provided inward of the tube.

In some embodiments, the post holding member comprises: a tube that extends in the up and down direction; one or more locking portions for locking the post, said one or more locking portions being projected from an inner circumferential surface of the tube; and one or more contact portions for touching an inner circumferential surface of the surrounding wall, said one or more contact portions being projected from an outer circumferential surface of the tube.

In some embodiments, the post holding member comprises: a tube that extends in the up and down direction; one or more locking portions for locking the post; a bottom portion that is coupled to a lower end of the tube and provided inward of the tube, and wherein the maximum length of the post holding member in the up and down direction is less than a depth in the up and down direction defined by the rim and the bottom portion of the receiving member.

In some embodiments, a clearance exists between the tube and the surrounding wall when the post holding member has been arranged inside of the receiving member.

In some embodiments, said one or more locking portions are provided at an upper end of the tube, and said one or more contact portions are provided at a lower end of the tube.

In some embodiments, the post holding member comprises: a tube that extends in the up and down direction; and one or more locking portions for locking the post, said one or more locking portions being projected from an inner circumferential surface of the tube, and wherein an outer circumferential surface of the tube can touch an inner circumferential surface of the surrounding wall.

A female snap button according to another aspect of the present invention comprises: an upper structure as described above; and a fixture for fixing the upper structure to a texture.

In some embodiments, the post holding member comprises: a tube that extends in the up and down direction, and a bottom portion that is coupled to a lower end of the tube and provided inward of the tube, and wherein when the post holding member has been arranged inside of the receiving member, said bottom portion of the post holding member which is to be passed through by the fixture is placed on said bottom portion of the receiving member which is to be passed through by the fixture.

There is provided a method of attaching an upper structure of a female snap button to a texture using a fixture according to another aspect of the present invention wherein the upper structure comprises a post holding member for holding a post of a male snap button, and a receiving member for receiving the post holding member the method comprising: a first step of arranging the post holding member inside of the receiving member, wherein the post holding member is inserted into a surrounding wall through an opening defined by a rim at which a peripheral portion is coupled to an upper end of the surrounding wall of the receiving member so that the post holding member is placed on a bottom portion inward of a lower end of the surrounding wall; and a second step of attaching the upper structure, in which the post holding member has been arranged inside of the receiving member, to a texture by a fixture.

In some embodiments, the first step includes pressing the post holding member into the receiving member through the opening.

In some embodiments, the post holding member comprises: a tube that extends in the up and down direction, and a bottom portion that is coupled to a lower end of the tube) and provided inward of the tube, and wherein at the first step, the bottom portion of the post holding member is placed on the bottom portion of the receiving member, and wherein at the second step, the upper structure is attached to the texture by the fixture through a shank of the fixture passing through both of the bottom portion of the receiving member and the bottom portion of the post holding member.

Advantageous Effects of Invention

According to the present invention, it may be facilitated that efficiency of attaching and fixing of a female snap button to texture may be improved.

DESCRIPTION OF EMBODIMENTS

Hereinafter, embodiments of the present invention will be described with reference to Figures. Each and every embodiment is not mutually exclusive, and a skilled person could properly combine them without requiring excess descriptions, and could understand the synergic effects by such combinations. Overlapping descriptions among embodiments will be basically omitted. Referenced figures are mainly for the purpose of illustrating the invention and may be simplified for the sake of convenience.

A central axis AX is illustrated by an alternate long and short dash line. In the cases of illustrated examples, the central axis AX may be provided at the center of a circular profile when a male snap button and a female snap button are viewed in front. Explanation can be made as follows. The central axis AX may be equal to a travel path of a male snap button when the male snap button is moved and snap-coupled to a stationary female snap button. Similarly, the central axis AX may be equal to a travel path of a female snap button when the female snap button is moved and snap-coupled to a stationary male snap button. The central axis AX may be equal to a travel path of respective male and female snap buttons when the male snap button and the female snap button are moved to be closer one another and snap-coupled together.

In the present specification, an up and down direction may be a direction directed along the central axis AX described above. In a plane orthogonal to the central axis AX, a direction approaching to the central axis AX may be referred to as inward and radially inward, and a direction directed away from the central axis AX may be referred to as outward and radially outward.

First Exemplary Embodiment

Figure 1:
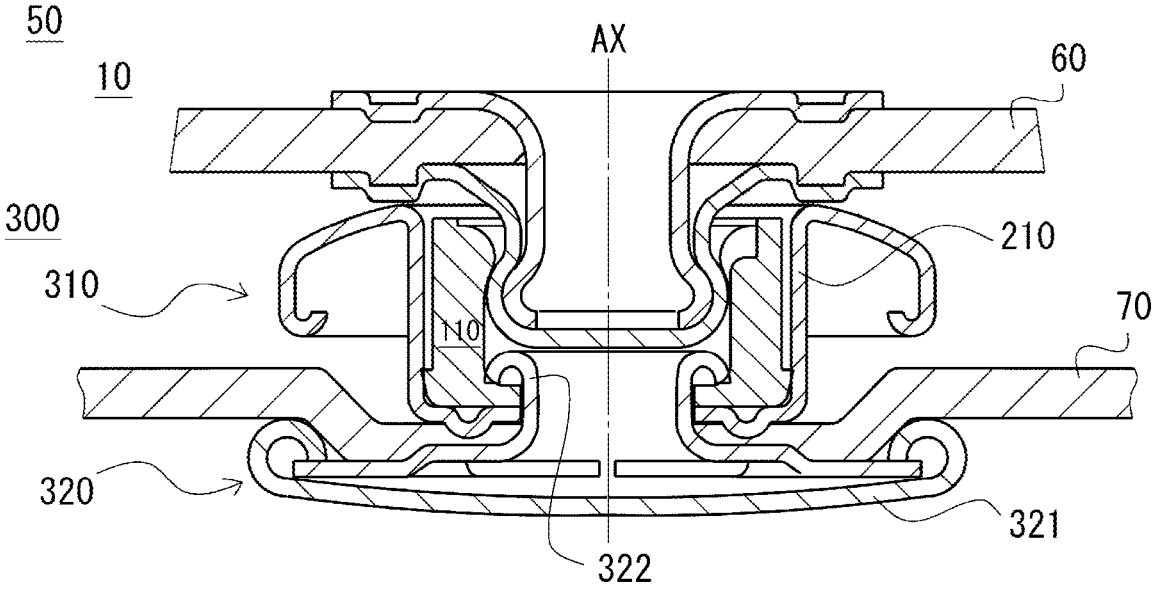
FIG. 1 is a schematic sectional view of a snap-coupled pair of male and female snap buttons according to a first exemplary embodiment of the present invention. Note that the female snap button and male snap button are individually attached and fixed to textures.
Figure 2:
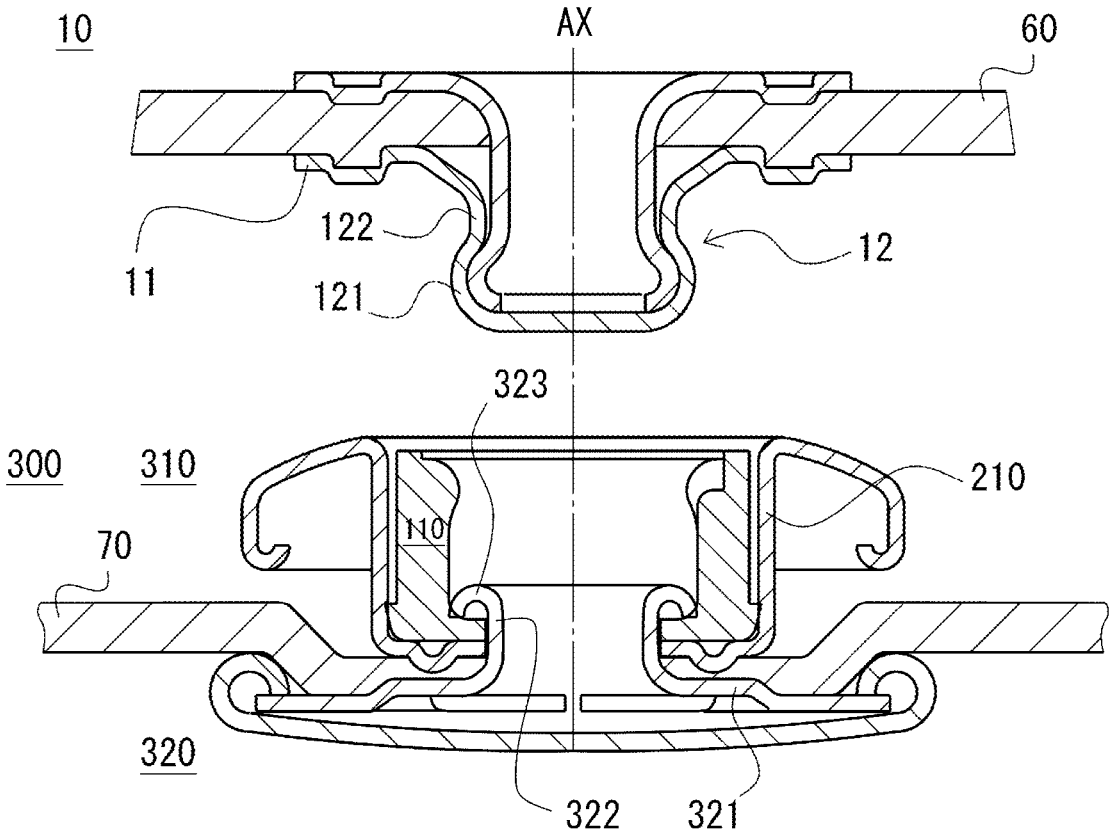
FIG. 2 is a schematic sectional view of a decoupled pair of male and female snap buttons from the snap-coupled state, according to a first exemplary embodiment of the present invention.
Figure 3:
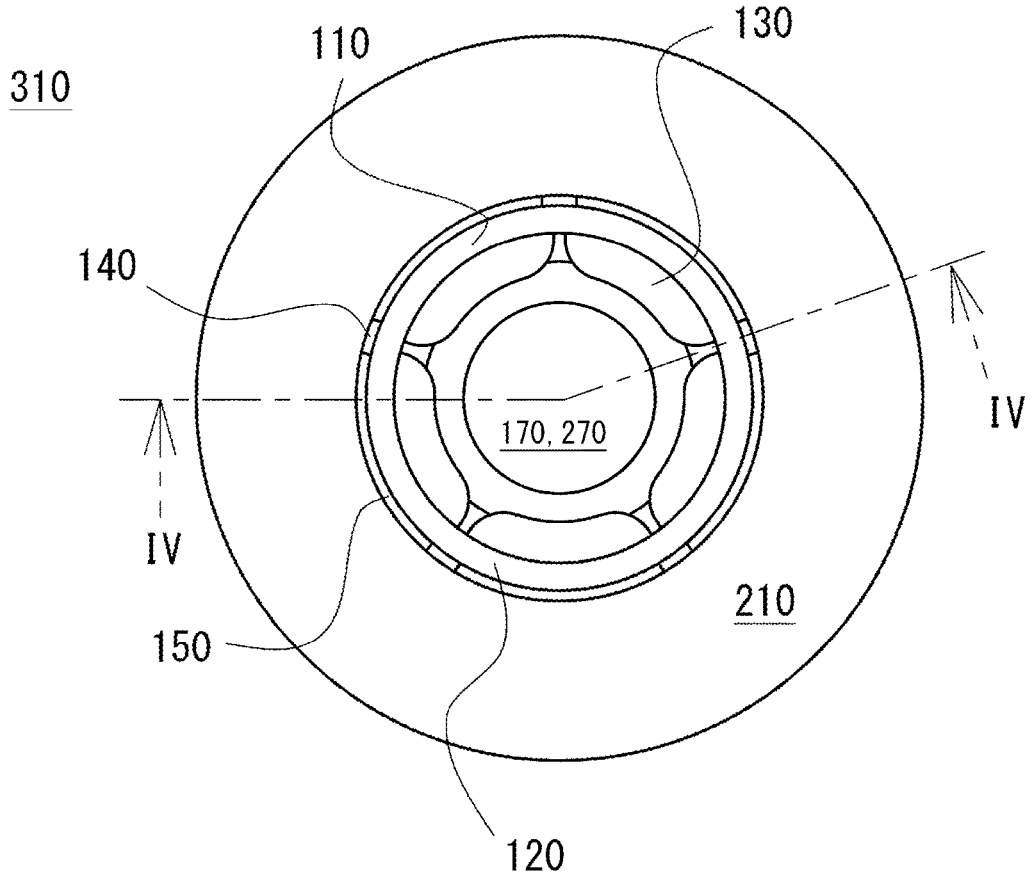
FIG. 3 is a top view of an upper structure of a female snap button according to a first exemplary embodiment of the present invention.
Figure 4:
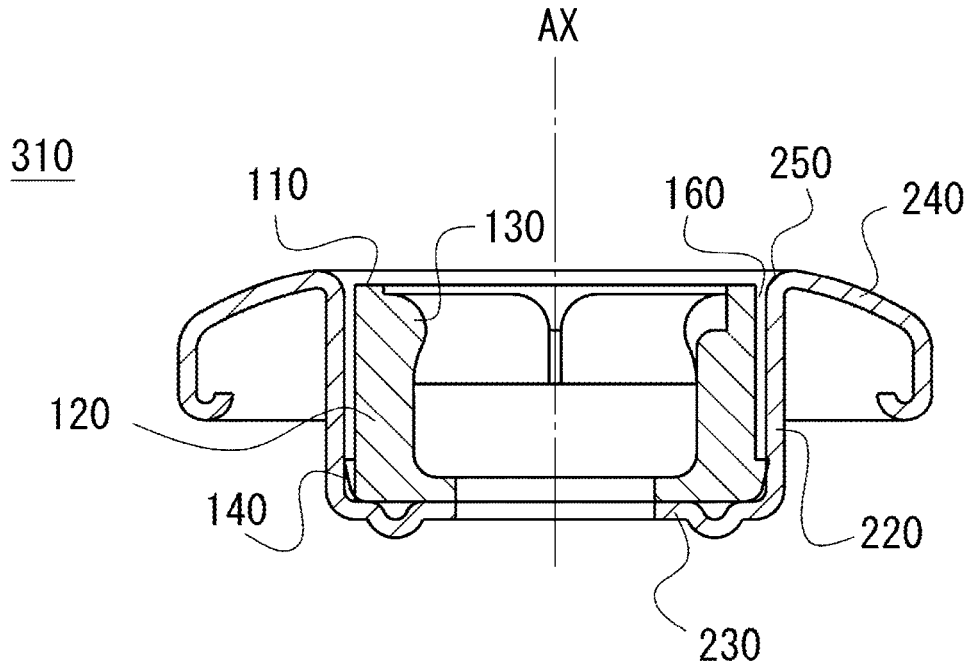
FIG. 4 is a sectional view of an upper structure of a female snap button according to a first exemplary embodiment of the present invention, schematically illustrating a section along Iv-Iv shown in FIG. 3.
Figure 5:
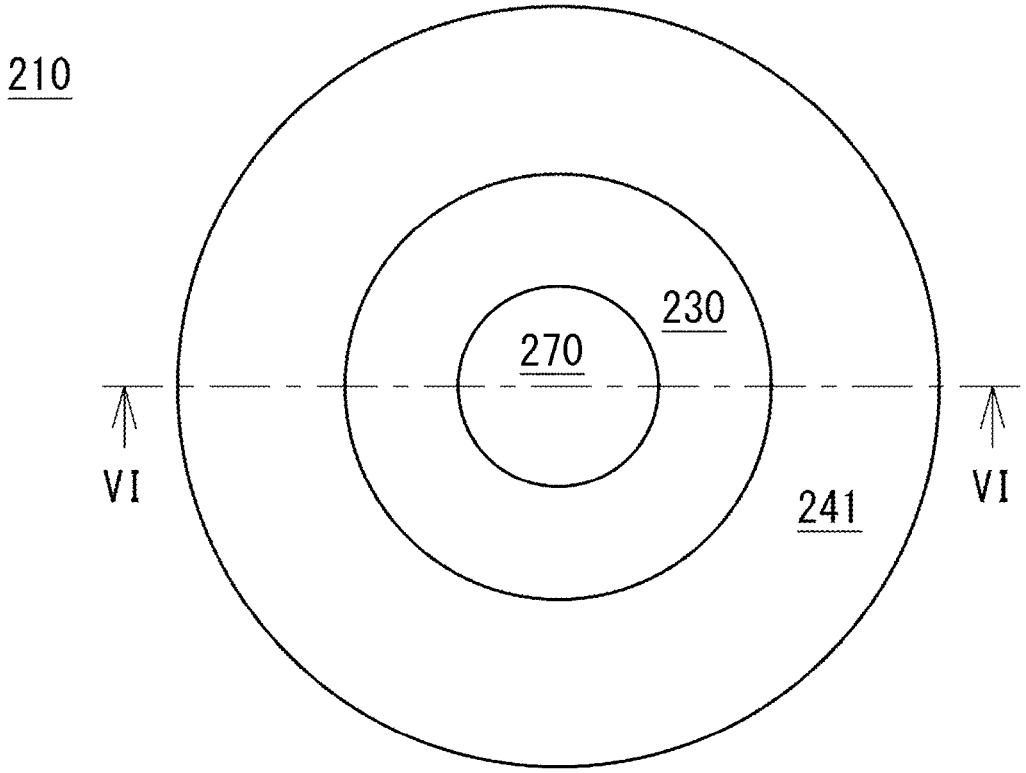
FIG. 5 is a top view of a receiving member of an upper structure of a female snap button according to a first exemplary embodiment of the present invention.
Figure 6:
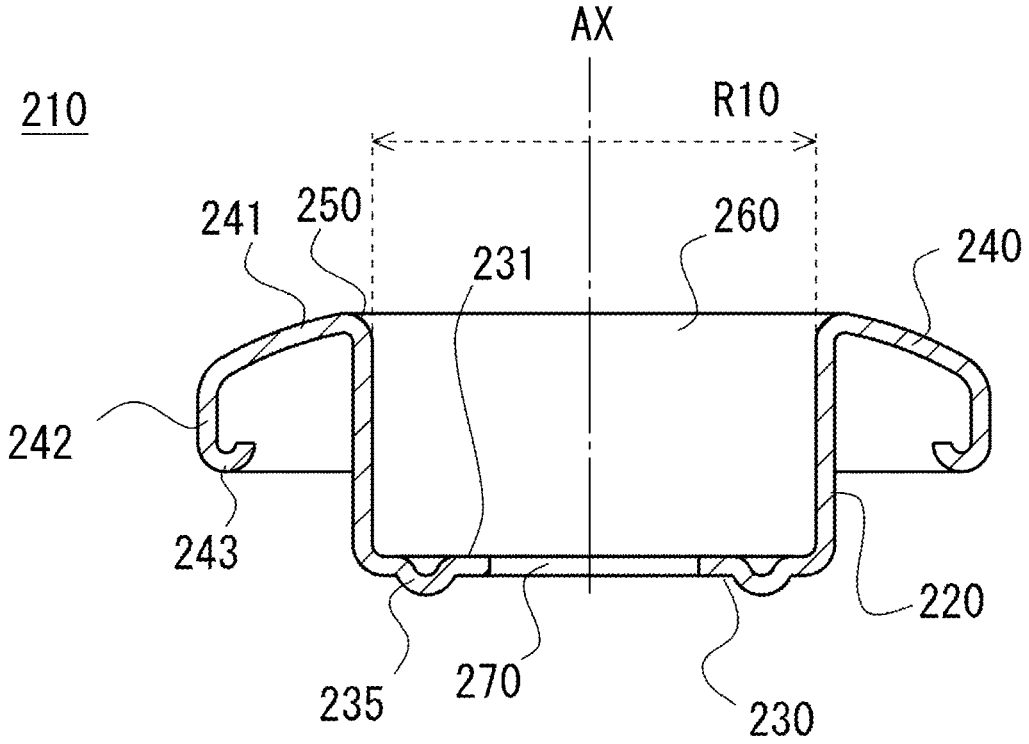
FIG. 6 is a sectional view of a receiving member of an upper structure of a female snap button according to a first exemplary embodiment of the present invention, schematically illustrating a section along VI-VI shown in FIG. 5.
Figure 7:
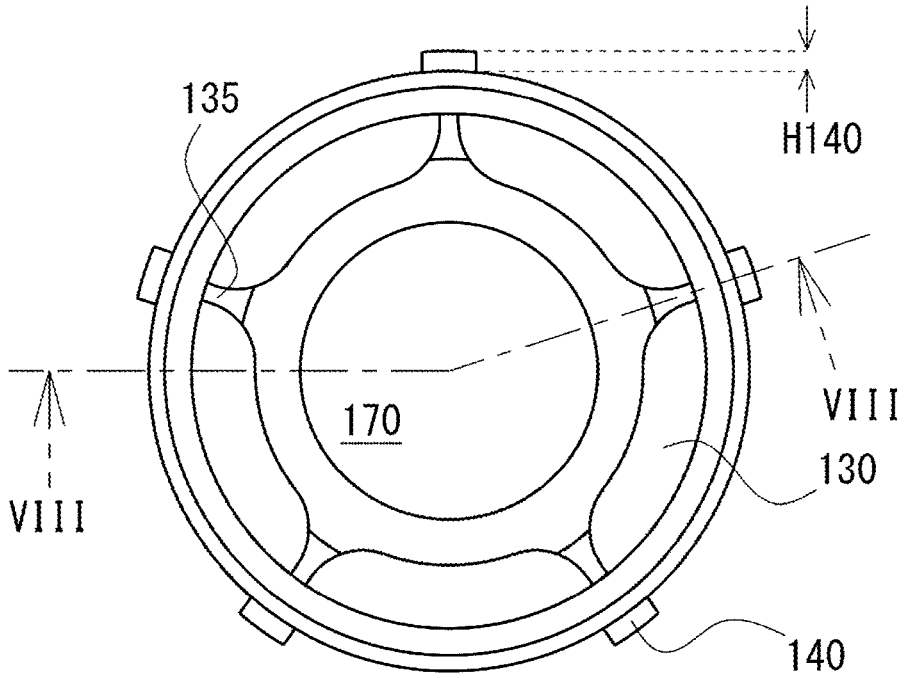
FIG. 7 is a top view of a post holding member of an upper structure of a female snap button according to a first exemplary embodiment of the present invention.
Figure 8:
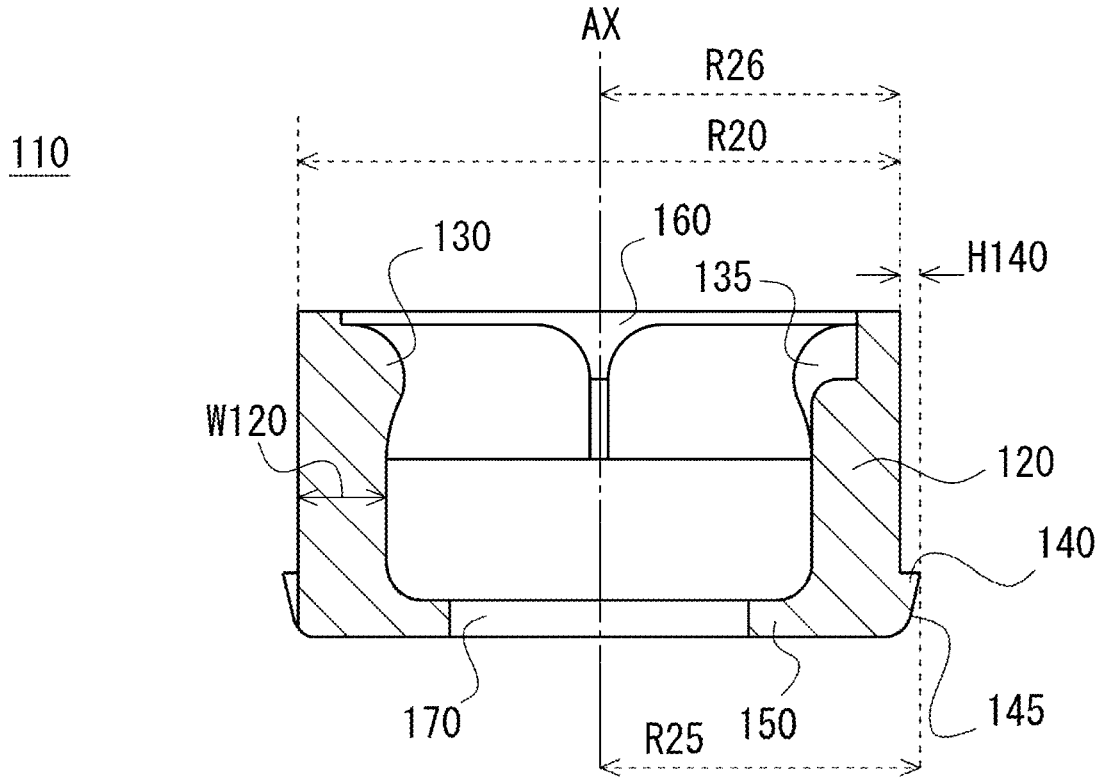
FIG. 8 is a sectional view of a post holding member of an upper structure of a female snap button according to a first exemplary embodiment of the present invention, schematically illustrating a section along VIII-VIII shown in FIG. 7.
Figure 9:
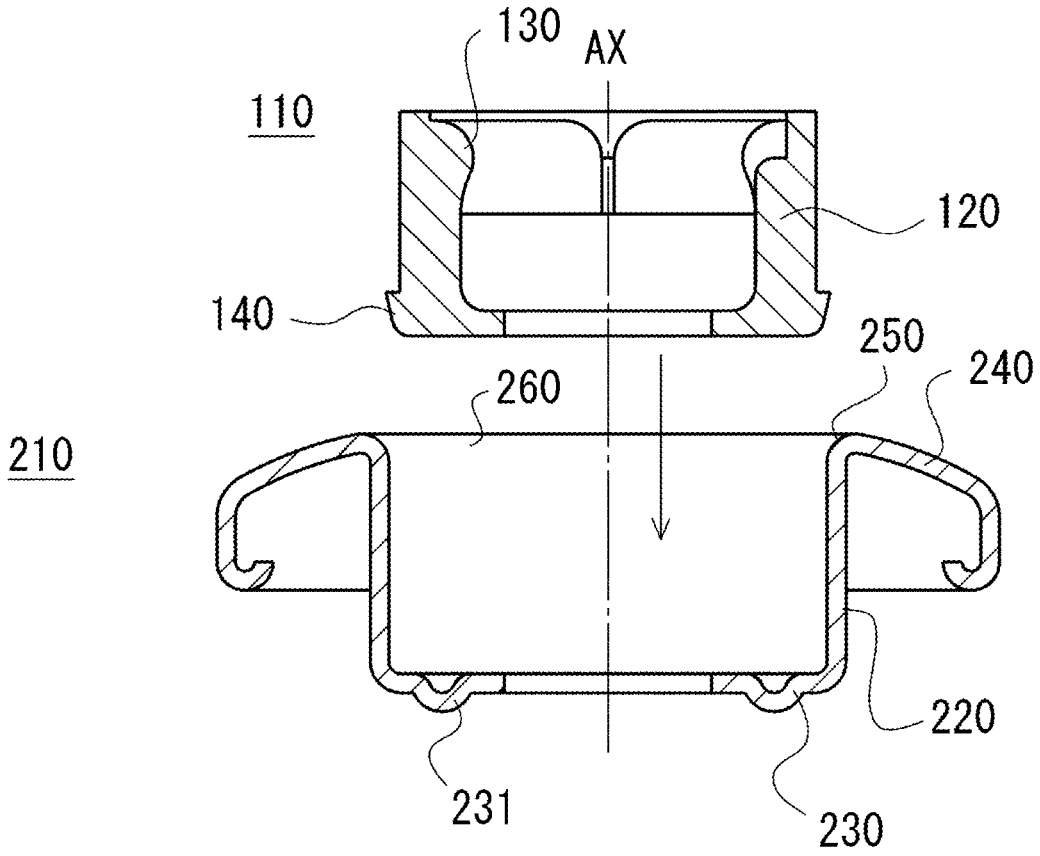
FIG. 9 is a process view illustrating an attaching and fixing process of a female snap button to a texture in accordance with a first exemplary embodiment of the present invention, wherein an arrow schematically illustrates an insertion and press-fit of a post holding member into a receiving member.
Figure 10:
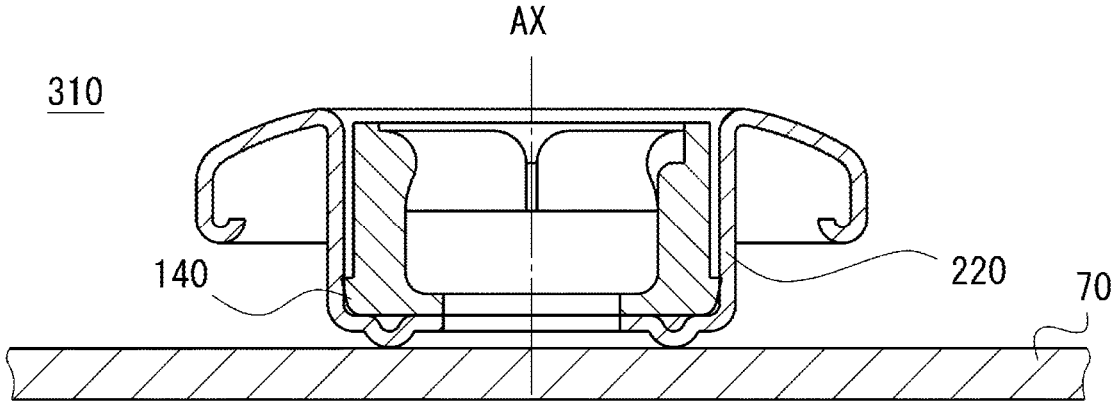
FIG. 10 is a process view illustrating an attaching and fixing process of a female snap button to a texture in accordance with a first exemplary embodiment of the present invention, illustrating that a post holding member has been arranged and housed in a receiving member. Also schematically illustrated is that an upper structure in which the post holding member has been arranged and housed in a receiving member is placed on a texture.
Figure 11:
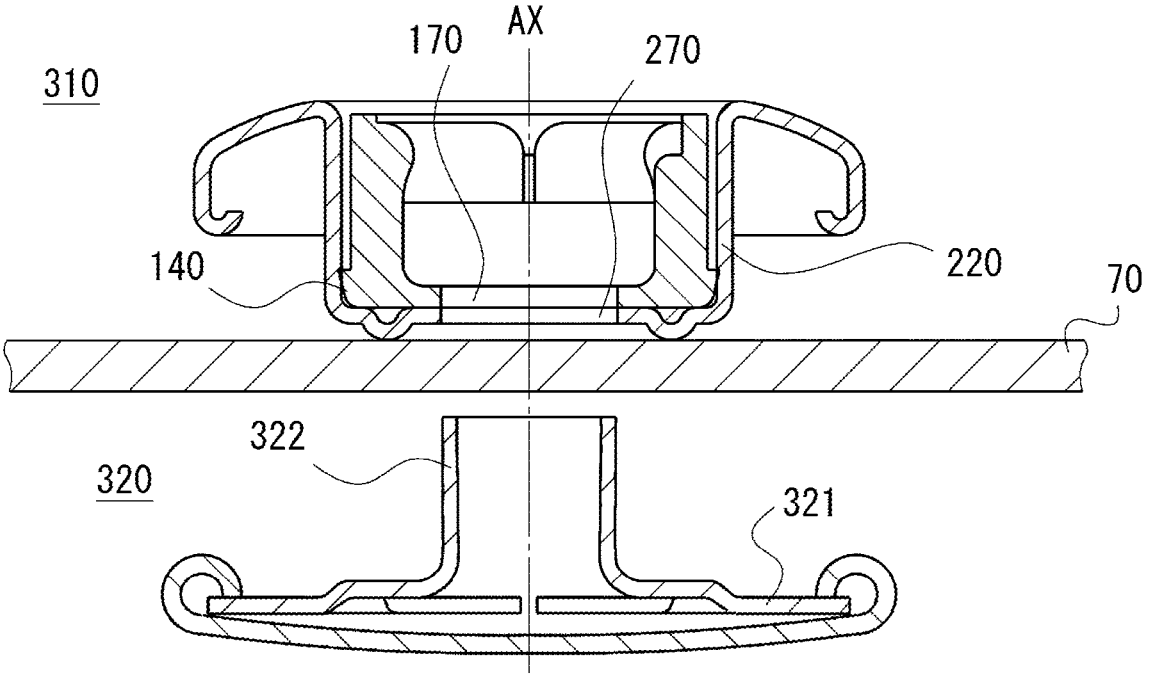
FIG. 11 is a process view illustrating an attaching and fixing process of a female snap button to a texture in accordance with a first exemplary embodiment of the present invention, illustrating that a fixture is placed beneath the texture while an upper structure in which a post holding member has been arranged and housed in a receiving member is placed on a texture.
Figure 12:
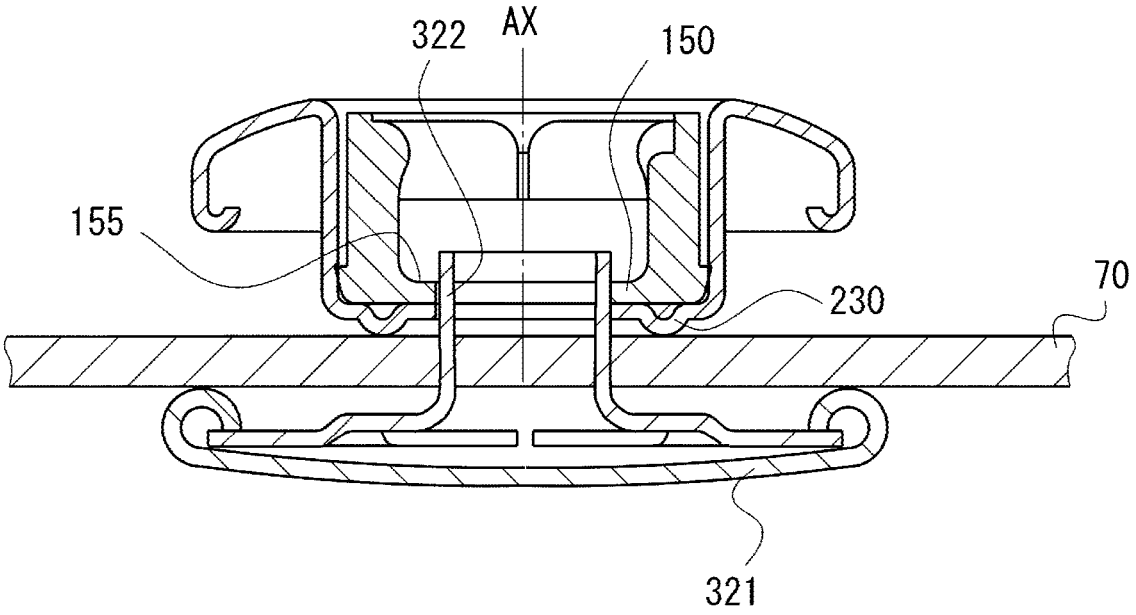
FIG. 12 is a process view illustrating an attaching and fixing process of a female snap button to a texture in accordance with a first exemplary embodiment of the present invention, illustrating that a hollow cylindrical shank of a fixture has penetrated a texture and a tip portion of the hollow cylindrical shank has been arranged in bottom holes of a receiving member and a post holding member which are co-axially arranged at the center and in communication in up and down direction.
Figure 13:
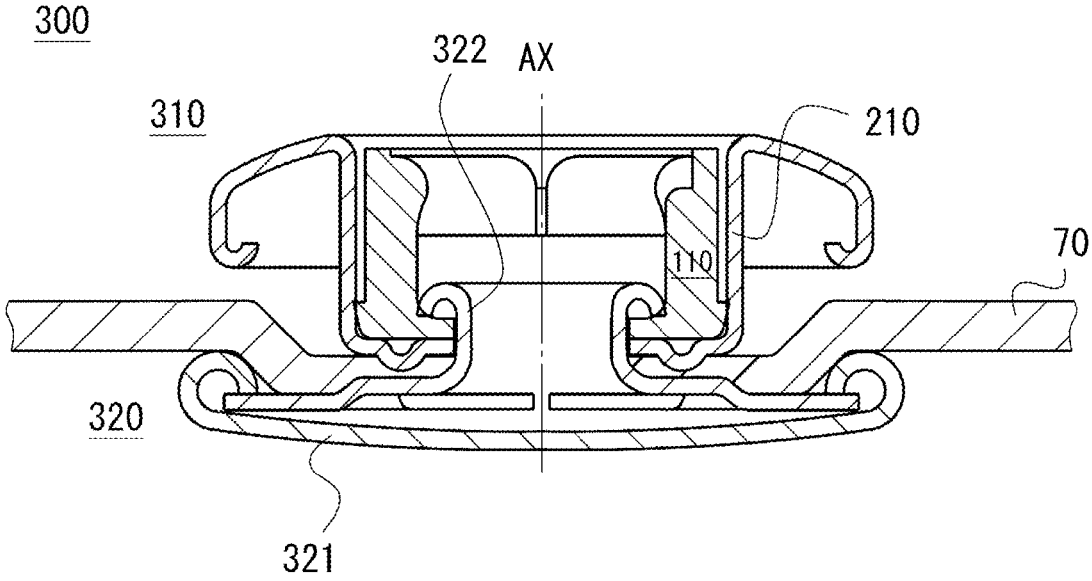
FIG. 13 is a process view illustrating an attaching and fixing process of a female snap button to a texture in accordance with a first exemplary embodiment of the present invention, illustrating that a tip portion of a hollow cylindrical shank arranged at bottom holes of a receiving member and a post holding member has been swaged radially outwardly so that a bottom portion around the bottom hole of the post holding member, a bottom portion around the bottom hole of the receiving member and the texture have been sandwiched between an outer curled portion of the hollow cylindrical shank formed by that swaging process and a base of a fixture.

A first exemplary embodiment will be described with reference to FIGS. 1 to 13. FIG. 1 is a schematic sectional view of a snap-coupled pair of male and female snap buttons. Note that the female snap button and male snap button are individually attached and fixed to textures. FIG. 2 is a schematic sectional view of a decoupled pair of male and female snap buttons from the snap-coupled state. FIG. 3 is a top view of an upper structure of a female snap button. FIG. 4 is a sectional view of an upper structure of a female snap button, schematically illustrating a section along IV-IV shown in FIG. 3. FIG. 5 is a top view of a receiving member of an upper structure of a female snap button. FIG. 6 is a sectional view of a receiving member of an upper structure of a female snap button, schematically illustrating a section along VI-VI shown in FIG. 5. FIG. 7 is a top view of a post holding member of an upper structure of a female snap button. FIG. 8 is a sectional view of a post holding member of an upper structure of a female snap button, schematically illustrating a section along VIII-VIII shown in FIG. 7. FIG. 9 is a process view illustrating an attaching and fixing process of a female snap button to a texture, wherein an arrow schematically illustrates an insertion and press-fit of a post holding member into a receiving member. FIG. 10 is a process view illustrating an attaching and fixing process of a female snap button to a texture, illustrating that a post holding member has been arranged and housed in a receiving member. Also schematically illustrated is that an upper structure in which the post holding member has been arranged and housed in a receiving member is placed on a texture. FIG. 11 is a process view illustrating an attaching and fixing process of a female snap button to a texture, illustrating that a fixture is placed beneath the texture while an upper structure in which a post holding member has been arranged and housed in a receiving member is placed on a texture. FIG. 12 is a process view illustrating an attaching and fixing process of a female snap button to a texture, illustrating that a hollow cylindrical shank of a fixture has penetrated a texture and a tip portion of the hollow cylindrical shank has been arranged in bottom holes of a receiving member and a post holding member which are co-axially arranged at the center and in communication in up and down direction. FIG. 13 is a process view illustrating an attaching and fixing process of a female snap button to a texture, illustrating that a tip portion of a hollow cylindrical shank arranged at bottom holes of a receiving member and a post holding member has been swaged radially outwardly so that a bottom portion around the bottom hole of the post holding member, a bottom portion around the bottom hole of the receiving member and the texture have been sandwiched between an outer curled portion of the hollow cylindrical shank formed by that swaging process and a base of a fixture.

As shown in FIGS. 1 and 2, a pair of male and female snap buttons 50 includes a male snap button 10 and a female snap button 300 which are co-axially arranged along the central axis AX. In FIGS. 1 and 2, the female snap button 300 is placed below the male snap button 10, and the male snap button 10 is placed above the female snap button 300. As would be instantly understood by a skilled person by viewing FIGS. 1 and 2, FIG. 1 illustrates a snap-coupled state of the male snap button 10 and the female snap button 300, and FIG. 2 illustrates a decoupled state shifted from the snap-coupled state.

Specific configuration of the male snap button 10 may be arbitrary and the illustrated one is merely an example. As shown in FIGS. 1 and 2, the male snap button 10 has been attached and fixed to a texture 60. The male snap button 10 may have a base 11 and a post 12. The illustrated exemplary base 11 may be a part for sandwiching the texture 70, and may present a circular profile centered around the central axis AX when viewed from top or bottom. The post 12 is provided and projected at the center of the base 11 of the circular profile, and extends downward along the central axis AX.

The post 12 may present a constricted shape in its projecting direction along the central axis AX. Specifically, the post 12 may have a neck 122 and a head 121, and the head 121 may be radially outwardly bulged or projected relative to the neck 122. Note that the illustrated exemplary male snap button 10 is configured from two metal plates which are shaped to sandwich the texture 60 at the periphery of the male snap button 10 and to construct the post 12 at the center of the male snap button 10. As described above, the specific configuration and shape of the male snap button 10 is arbitrary, and male snap buttons of other configurations and shapes can be used.

The female snap button 300 may have an upper structure 310 placed on the texture 70, and a fixture 320 for fixing the upper structure 310 onto the texture 70. In the present specification, the name of the upper structure is determined based on a fact that a structure of the female snap button to be fixed to a texture by a fixture is placed above the texture as thoroughly seen in FIGS. 1, 2, 10, and 13 of this application. Regardless of the position and orientation of the structure of the female snap button to be fixed to the texture by the fixture, that structure should be an upper structure if that structure comprises a post holding member and a receiving member described below.

The upper structure 310 may be configured from two parts of a post holding member 110 and a receiving member 210. It is envisaged that, in other embodiments, additional different parts may be included in the upper structure 310. The post holding member 110 may be a part for holding the post 12 of the male snap button 10. The post holding member 110 may be an elastic member which can be elastically deformable, for example. The post holding member 110 may be an elastically deformable resin member, for example. The receiving member 210 may be a part for receiving the post holding member 110. The receiving member 210 may be a resin or metal member with a rigidity of some extent, for example.

The fixture 320 may have a base 321 and a hollow cylindrical shank 322. The base 321 may be a flat disk and may present a substantially circle profile centered around the central axis AX. The base 321 may be arranged below the texture 70. The hollow cylindrical shank 322 is provided and projected at the center of the base 321 having the substantially circle profile, and extends along the central axis AX. The hollow cylindrical shank 322 extends upward along the central axis AX as shown in FIGS. 1 and 2.

The illustrated exemplary fixture 320 has a main metal plate shaped to construct a hollow cylindrical shank at the center of the fixture 320, and a cover metal plate attached to the main metal plate to cover the bottom side of the main metal plate. The base 321 of the fixture 320 includes a laminated portion of the main metal plate and the cover metal plate. Specific configuration and shape of the fixture is arbitrary, and fixtures of other configurations and shapes can be used.

FIGS. 1 and 2 show a state in which the tip portion of the hollow cylindrical shank 322 has been radially outwardly bent to form an outer curled portion 323. Note that, in FIGS. 11 and 12, the hollow cylindrical shank 322 before being plastically deformed is illustrated. The hollow cylindrical shank 322 may be adapted to penetrate the texture 70. The hollow cylindrical shank 322 may be a metal hollow column, suitably ensuring the penetration of the texture 70.

As shown in FIGS. 3 to 6, the receiving member 210 may have a surrounding wall 220 that extends in the up and down direction along the central axis AX to surround the post holding member 110, a bottom portion 230 that is coupled to a lower end of the surrounding wall 220 and provided inward of the surrounding wall 220, a peripheral portion 240 that is coupled to an upper end of the surrounding wall 220 and provided outward of the surrounding wall 220. The bottom portion 230 is provided radially inward of the surrounding wall 220, and the peripheral portion 240 is provided radially outward of the surrounding wall 220.

The surrounding wall 220 is shaped to be annular around the central axis AX. The bottom portion 230 is shaped to be annular around the central axis AX. The peripheral portion 240 is shaped to be annular around the central axis AX. The surrounding wall 220 may be a cylindrical tube presenting a circle of an internal diameter R10 in section. In other embodiments, the surrounding wall 220 may present a non-circle in section in a plane orthogonal to the central axis AX.

A bent or curved rim 250 may be provided between the upper end of the surrounding wall 220 and the peripheral portion 240, and this rim 250 defines an opening 260 through which the post holding member 110 can be inserted into the receiving member 210. The width of the opening 260 is substantially identical to the internal diameter R10 of the surrounding wall 220.

In the present embodiment, the post holding member 110 can be pressed into the receiving member 210 through the opening 260, not necessarily limited though. In this case, coming-off or detachment of the post holding member 110 from the receiving member 210 may be preferably hindered.

The bottom portion 230 may be provided to enable a stable placement of the receiving member 210 onto the texture 70, and may define a stop position for the post holding member 110 inserted into the surrounding wall 220. The center of the bottom portion 230 at which the central axis AX extends through may be provided with a bottom hole 270. The bottom hole 270 may be a circular opening centered around the central axis AX. The hollow cylindrical shank 322 of the fixture 320 may be allowed to pass there-through via the bottom hole 270. One or more downwardly projecting bulges 235 are provided at the periphery of the bottom hole 270 of the bottom portion 230, facilitating that the texture 70 is sandwiched by the cooperating bulges 235 and the base 321 of the fixture 320.

The illustrated exemplary peripheral portion 240 includes a peripheral sloped portion 241 shaped like a ring in top view and gradually sloped downward as radially outwardly extending from the upper end of the surrounding wall 220, and a tube-like peripheral wall 242 extending downward straight from the peripheral end of the peripheral sloped portion 241. The lower end of the peripheral wall 242 is provided with a curled edge 243 curled radially inwardly. A bent portion is provided between the peripheral sloped portion 241 and the peripheral wall 242. The peripheral portion 240 is provided so that the mechanical strength of the upper structure 310 of the female snap button 300 is increased. Also, the peripheral portion 240 is provided so that visual recognition of the upper structure 310 of the female snap button 300 will be easier, and thus insertion of the post 12 of the male snap button 10 into the post holding member 110 of the female snap button 300 will be easier. The shape of the peripheral portion 240 should not be limited to the illustrated one and other various shapes are envisaged.

The post holding member 110 may include a tube 120 that extends, similar to the surrounding wall 220 of the receiving member 210, in the up and down direction along the central axis AX. One or more locking portion 130 for locking the post 12 may be provided at and projected from the inner circumferential surface of the tube 120, and one or more contact portions 140 for touching the surrounding wall 220 may be provided at and projected from the outer circumferential surface of the tube 120. The locking portion 130 may be provided at the upper end of the tube 120, and the contact portion 140 may be provided at the lower end of the tube 120. The locking portion 130 may be a portion being projected radially inwardly and may be referred to as a projected locking portion.

In the illustrated example, a plurality of five locking portions 130 are arranged around the central axis AX at a constant angular interval. Each locking portion 130 is individually and independently provided at the inner circumferential surface of the tube 120. The respective locking portions 130 are arranged at the constant angular interval around the central axis AX, but not necessarily limited to in other embodiments. In the illustrated case, the five locking portion 130 are arranged by 72° around the central axis AX.

Radially outwardly recessed recesses 135 may be provided between the locking portions 130. The five locking portions 130 are divided by the five recesses 135. The circumferential length of the locking portion 130 may be greater than the circumferential length of the recesses 135, ensuring that the head 121 of the post 12 may be sufficiently held. The radially outwardly recessed recesses 135 may be provided between the radially inwardly projected locking portions 130, preferably ensuring that the locking portions 130 can be radially outwardly displaced when the post 12 is inserted into the post holding member 110.

In the illustrated example, a plurality of five contact portions 140 are arranged around the central axis AX at a constant angular interval. Each contact portion 140 is individually and independently provided at the outer circumferential surface of the tube 120. The respective contact portions 140 are arranged at a constant angular interval around the central axis AX, but not necessarily limited to in other embodiments. In the illustrated case, the five contact portions 140 are arranged by 72° around the central axis AX. The diameter of the post holding member 110 at a place where the contact portion 140 is provided at and projected from the outer circumferential surface of the tube 120 may be greater than the diameter defined by inner circumferential surface of the surrounding wall 220 of the receiving member 210.

The contact portion 140 may be a radially outwardly projected portion having a rectangular shape in top view. The contact portion 140 may extend for a distance shorter than that of the locking portion 130 in the circumferential direction around the central axis AX, and may extend for a distance slightly longer than that of the recess 135 in the circumferential direction. The amount of radially outward projection of the contact portion 140 may increase along the central axis AX from the lower side to the upper side. Accordingly, a sloped surface 145 sloped radially inwardly from the upper side to the lower side along the central axis AX may be provided at the outer circumferential surface of the contact portion 140. The sloped surface 145 may allow easier insertion of the post holding member 110 into the receiving member 210.

As described above, in the prevent embodiment, the post holding member 110 can be pressed into the receiving member 210 through the opening 260. Specifically, when the post holding member 110 is inserted into the surrounding wall 220 of the receiving member 210, the contact portion 140 of the post holding member 110 may touch the inner circumferential surface of the surrounding wall 220 of the receiving member 210 and against this drag force, the post holding member 110 is pressed into the surrounding wall 220 of the receiving member 210 so that the post holding member 110 is placed on the bottom portion 230 of the receiving member 210. In this case, plastic deformation of the receiving member 210 may not be required to keep on confining the post holding member 110 inside of the receiving member 210, thereby improvement of manufacturing efficiency being facilitated.

The number or size of the contact portion 140 can be changed to regulate a force required to press the post holding member 110 into the receiving member 210. In the illustrated embodiment, the number of contact portions 140 and the number of locking portions 130 are equal, but not necessarily limited to and it is envisaged that the number of contact portions 140 differs from the number of locking portions 130. In the illustrated case, the five contact portions 140 are provided, but the number of contact portions 140 could be reduced to two, three or four. Contrary to this, the number of contact portions 140 could be increased to six, seven or eight.

In the present embodiment, the locking portions 130 are provided at the upper end of the tube 120, and the contact portions 140 are provided at the lower end of the tube 120. Furthermore, the contact portions 140 are provided at positions corresponding to positions between the adjacent locking portions 130 in the circumferential direction around the central axis AX and, in particular, they are provided at radially outward positions relative to the above-described recesses 135. These each and both configurations may prevent the radially outward displacement of the locking portion 130 from being hindered by the contact portion 140.

As illustrated, a plurality of contact portions 140 are arranged in the circumferential direction around the central axis AX at a constant angular interval, thereby preventing the outer circumferential surface of the tube 120 from directly touching the inner circumferential surface of the surrounding wall 220. When the outer circumferential surface of the tube 120 and the inner circumferential surface of the surrounding wall 220 touch one another widely, greater force may be required for pressing the post holding member 110 into the receiving member 210. It should be noted that, when the post holding member 110 has been arranged inside of the receiving member 210 as shown in FIG. 4, a clearance 160, in accordance with the contact portion 140, exists between the outer circumferential surface of the tube 120 and the inner circumferential surface of the surrounding wall 220. The clearance 160 is positioned above the contact portion 140, in other words closer to the opening 260 than the contact portion 140.

In the present embodiment, the post holding member 110 is pressed into the receiving member 210. However, in other embodiments, the post holding member 110 may be loosely inserted into the receiving member 210, and then an adhesive may be injected between the post holding member 110 and the receiving member 210 so that they are fixed together. As would be immediately understandable from the following descriptions, particularly from FIG. 13, both of the post holding member 110 and the receiving member 210 are fixed to the texture 70 by the fixture 320. In light of this, the fixing based on the use of the adhesive may be omitted in yet another embodiments.

The outer diameter R20 of the tube 120 shown in FIG. 8 is less than the inner diameter R10 of the surrounding wall 220. The spacing R25 between the central axis AX and the radially outward end of the contact portion 140 in a plane orthogonal to the central axis AX may be greater than the spacing R26 between the central axis AX and the outer circumferential surface of the tube 120 in the same plane. R20<(R25×2) is satisfied. (R10/2)<R25 is satisfied, and (R10/2)>R26 is satisfied. The amount of projection or projection height H140 of the contact portion 140 in the radially outward direction from the outer circumferential surface of the tube 120 can be calculated by subtracting the spacing R26 from the spacing R25. The projection heights H140 of the respective contact portions 140 are equal one another, but may be different in another embodiment.

The post holding member 110 is provided with a bottom portion 150. The bottom portion 150 may be coupled to the lower end of the tube 120 and provided inward of the tube 120. The bottom portion 150 is provided radially inward of the tube 120. The bottom portion 150 of the post holding member 110 is placed on the bottom portion 230 of the receiving member 210. The bottom portion 150 of the post holding member 110 and the bottom portion 230 of the receiving member 210 are both passed through by the fixture 320. The bottom portion 150 is shaped like a ring around the central axis AX and a bottom hole 170 having a circular shape in top view is provided at the center of the bottom portion 150 at which the central axis AX extends through. The bottom hole 170 is a circular opening centered around the central axis AX. The bottom hole 170 allows the hollow cylindrical shank 322 of the fixture 320 to pass therethrough. The bottom hole 170 of the post holding member 110 and the bottom hole 270 of the receiving member 210 present a perfectly identical or substantially identical circular opening shape which allows the insertion of the hollow cylindrical shank 322. When the post holding member 110 has been arranged inside of the receiving member 210, the bottom hole 170 of the post holding member 110 is arranged over and in co-axial spatial communication with the bottom hole 270 of the receiving member 210, defining the insertion passage for the hollow cylindrical shank 322.

With reference to FIGS. 9-13, descriptions will be made with respect to a method of attaching or fixing a female snap button 300 against a texture 70. Firstly, as shown in FIG. 9, in a first step, the post holding member 110 is inserted and pressed into the receiving member 210 through the opening 260 of the receiving member 210 so that the post holding member 110 is arranged inside of and housed by the receiving member 210. The opening 260 is defined by a rim 250 between the upper end of the surrounding wall 220 and the peripheral portion 240. A ring-like curved rim shaped by the rim 250 around the opening 260 may ensure easier insertion of the post holding member 110 into the surrounding wall 220 of the receiving member 210. The sloped surface 145 of the contact portion 140 provided at the outer circumferential surface of the tube 120 may ensure easier insertion of the post holding member 110 into the surrounding wall 220 of the receiving member 210. The maximum length of the post holding member 110 in the up and down direction which is identical to the extending direction of the tube 120 is less than the depth in the up and down direction defined by the rim 250 and the bottom portion 230 of the receiving member 210 such that the post holding member 110 is totally housed by the receiving member 210 and the post holding member 110 does not project out of the receiving member 210.

As described above, during the insertion of the post holding member 110 into the surrounding wall 220 of the receiving member 210, the respective contact portions 140 provided at the outer circumferential surface at the lower end of the tube 120 of the post holding member 110 touch the inner circumferential surface of the surrounding wall 220 of the receiving member 210, thus causing a drag force. The post holding member 110 is pressed into the receiving member 210 by a force exceeding that drag force, and the post holding member 110 is housed and fixed in the receiving member 210 through elastic deformation of the post holding member 110 including the contact portion 140. The inner circumferential surface of the surrounding wall 220 of the receiving member 210 may be an even surface free of projections and recesses, thus the downward movement of the contact portion 140 may not extremely be hindered. The peripheral portion 240 of the receiving member 210 may be convenient for a machine or human to grasp, and facilitates easier insertion of the post holding member 110 into the receiving member 210. In another embodiment, the lower end of the surrounding wall 220 of the receiving member 210 may be provided with a receiving recess which is radially outwardly recessed for receiving the contact portion 140.

The post holding member 110 may be arranged and housed in the receiving member 210 so that the upper structure 310 of the female snap button 300 may be configured. This upper structure 310 is placed on the texture 70 as shown in FIG. 10. As shown in FIG. 11, the fixture 320 is provided below the texture 70. Next, as shown in FIG. 12, the hollow cylindrical shank 322 of the fixture 320 penetrates the texture 70, passes through the bottom hole 270 of the receiving member 210, and passes through the bottom hole 170 of the post holding member 110. The tip portion of the hollow cylindrical shank 322 is positioned upward relative to the bottom surface 155 of the bottom portion 150 of the post holding member 110.

The upper structure 310 and the texture 70 may be stationary, and the fixture 320 may be displaced toward the stationary texture 70 and the upper structure 310. Alternatively, the fixture 320 may be stationary, and the texture 70 and the upper structure 310 may be displaced toward the stationary fixture 320.

Then, in a second step, the hollow cylindrical shank 322 is swaged by a punch. Accordingly, the tip portion of the hollow cylindrical shank 322 is bent radially outwardly to form the outer curled portion 323. The outer curled portion 323 pushes the bottom portion 150 of the post holding member 110 downward so that the bottom portion 150 of the post holding member 110 and the bottom portion 230 of the receiving member 210 are sandwiched between the outer curled portion 323 and the base 321 of the fixture 320. The attaching and fixing of the female snap button 300 to the texture 70 is thus achieved. It should be noted that the outer curled portion 323 is a portion of the hollow cylindrical shank 322 that has been plastically deformed and thus may be referred as a plastically deformed portion.

The above-described attaching and fixing process of the female snap button 300 to the texture 70 may be performed by using a fully or partially automated machine. The texture 70 may be of any kind of material and there is no outstanding limitation. A sheet member may be sufficient for the texture 70.

Second Embodiment

Figure 14:
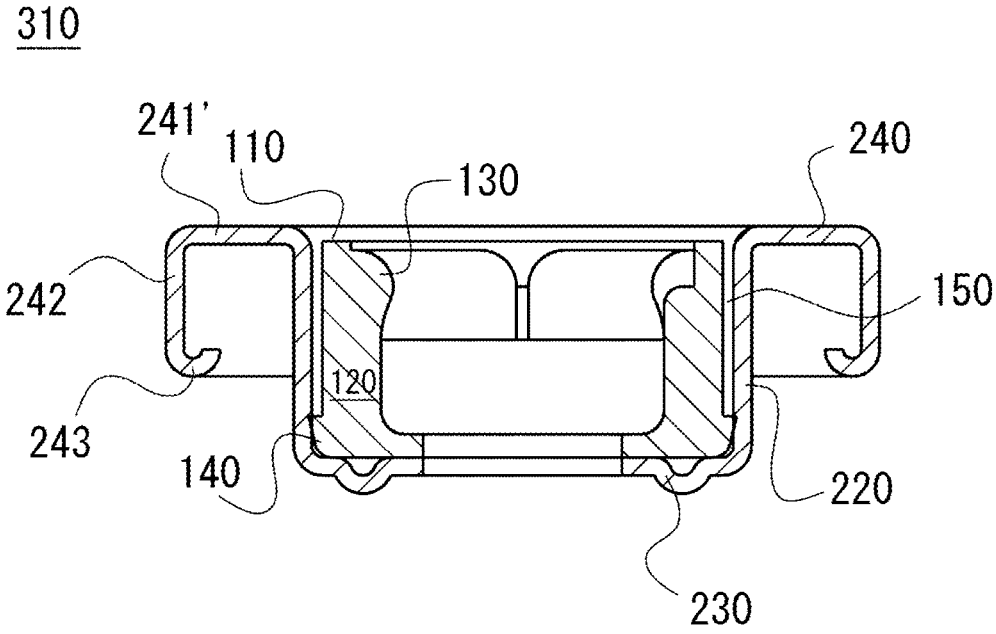
FIG. 14 is a sectional view of an upper structure of a female snap button according to a second exemplary embodiment of the present invention.

With reference to FIG. 14, a second embodiment will be described. FIG. 14 is a sectional view of an upper structure of a female snap button. In this embodiment, as shown in FIG. 14, the specific configuration and the shape of the peripheral portion 240 of the receiving member 210 differs from that of the first embodiment. Even in such case, similar effects could be achieved as that of the first embodiment.

In the first embodiment, the peripheral portion 240 is provided with the peripheral sloped portion 241. In contrast, the peripheral portion 240 is provided with a peripheral flat portion 241' alternative to the peripheral sloped portion 241.

Third Embodiment

Figure 15:
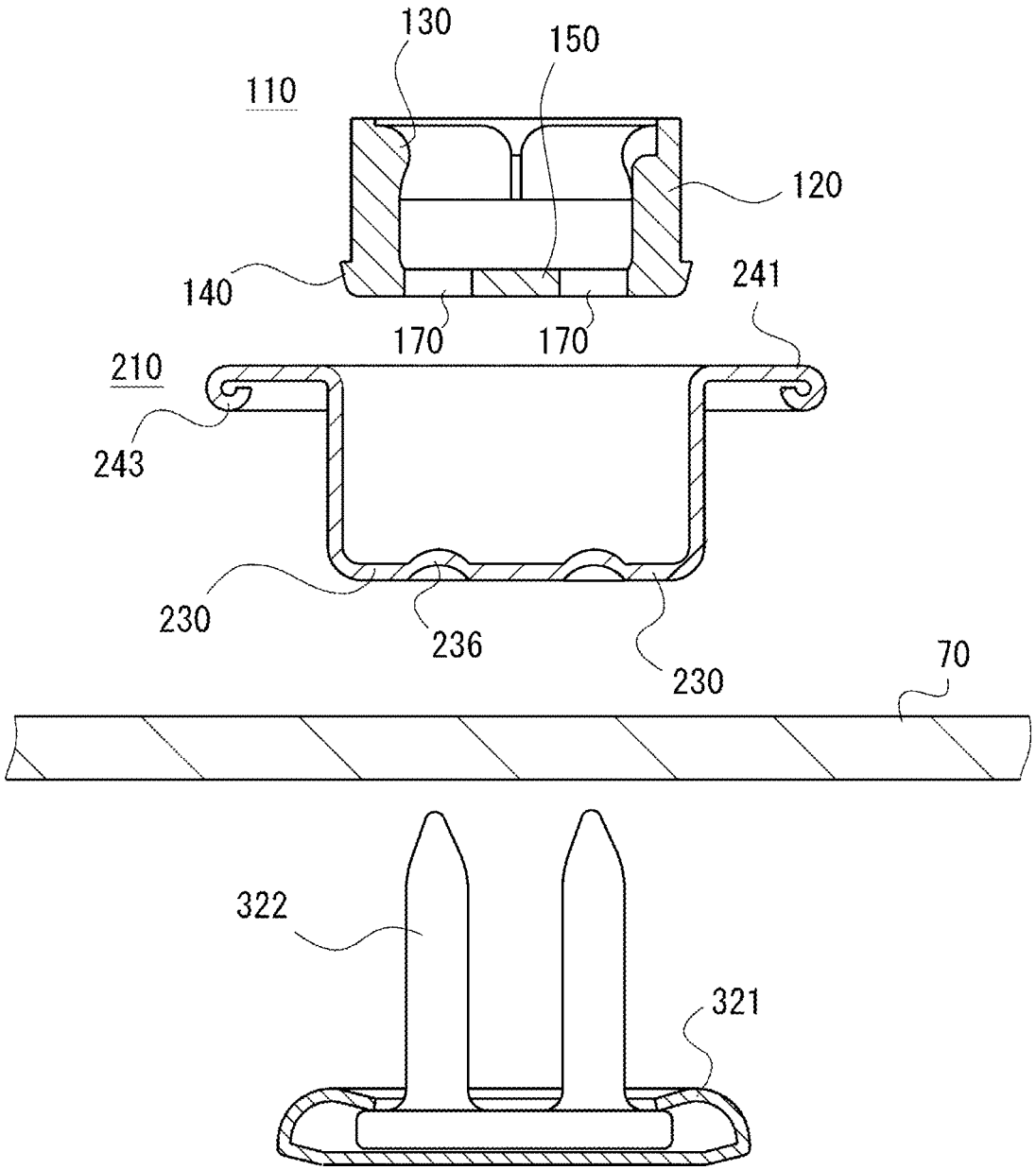
FIG. 15 is a schematic exploded sectional view of a female snap button before being attached to a texture in accordance with a third exemplary embodiment of the present invention.
Figure 16:
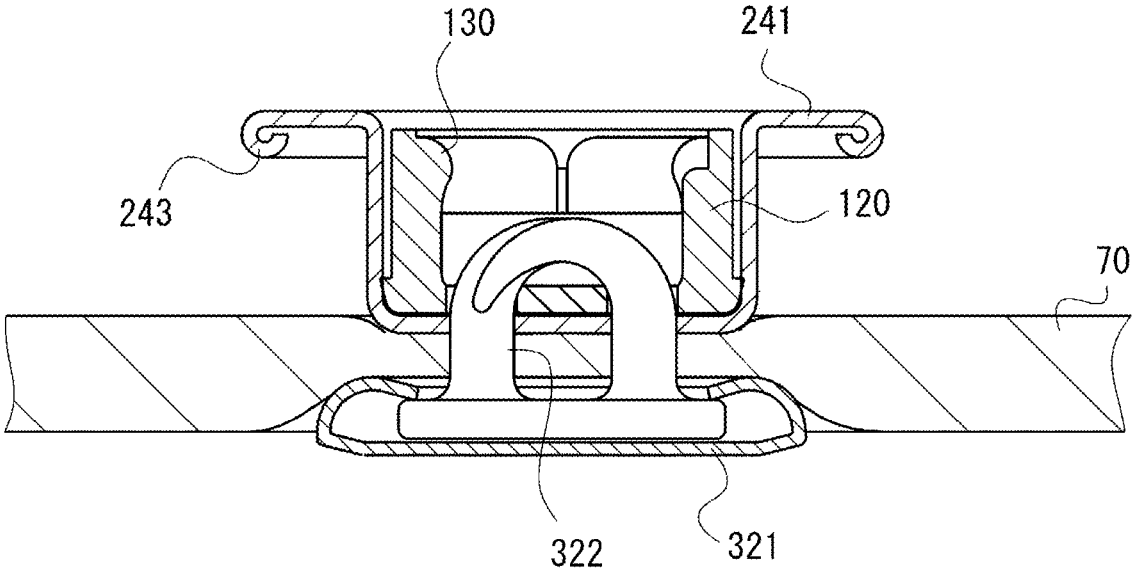
FIG. 16 is a schematic sectional view of a female snap button after being attached to a texture in accordance with a third exemplary embodiment of the present invention.

With reference to FIGS. 15 and 16, a third embodiment will be described. FIG. 15 is a schematic exploded sectional view of a female snap button before being attached to a texture. FIG. 16 is a schematic sectional view of a female snap button after being attached to a texture. In this embodiment, as shown in FIGS. 15 and 16, specific configuration of the fixture 320 differs from that of the above described embodiments. Furthermore, differences are observed in specific configuration and shape of the receiving member 210 and specific configuration and shape of the post holding member 110 too. Even in such case, similar effects could be achieved as that of the first embodiment.

The fixture 320 has two cylindrical shanks 322. The bottom portion 230 of the receiving member 210 is provided with concave fragile portions 236 to be penetrated by the cylindrical shanks 322. One spatially communicated hole 170 or two spatially separated bottom holes 170 may open at the bottom portion 150 of the post holding member 110 for allowing the respective cylindrical shanks 322 to pass there-through. As would be understandable from FIG. 16, the cylindrical shanks 322 of the fixture 320 penetrate the texture 70, penetrate the fragile portions 236 of the bottom portion 230 of the receiving member 210, and pass through the bottom holes 170. After that, the respective tip portions of the two cylindrical shanks 322 are swaged to be bent closer to another one of the cylindrical shanks 322 so that the fixing of the upper structure 310 to the texture 70 by the fixture 320 is achieved.

The receiving member 210 is not provided with the peripheral wall 242 described in the first embodiment.

Fourth Embodiment

Figure 17:
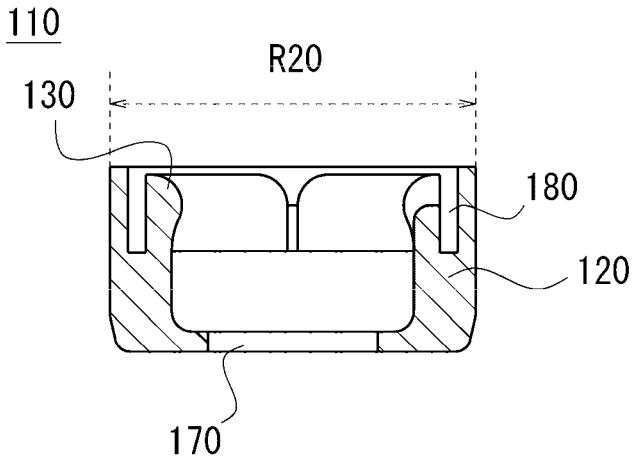
FIGS. 17*a*, 17*b*, 17*c*, collectively referred to herein as FIG. 17, are sectional views for illustrating a variation of a post holding member of a female snap button according to a fourth exemplary embodiment of the present invention.
Figure 17:
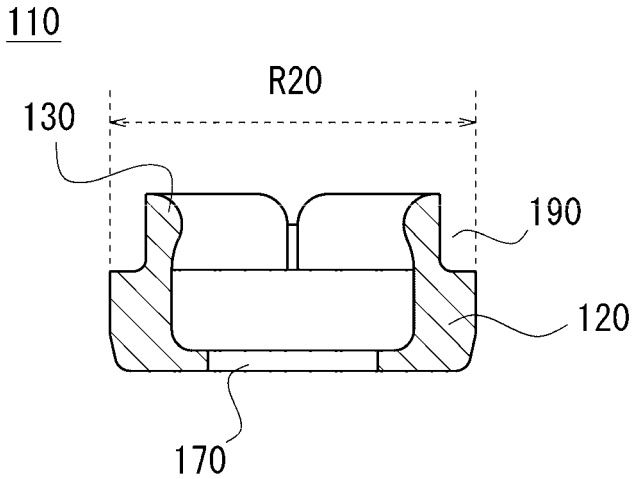
Figure 17:
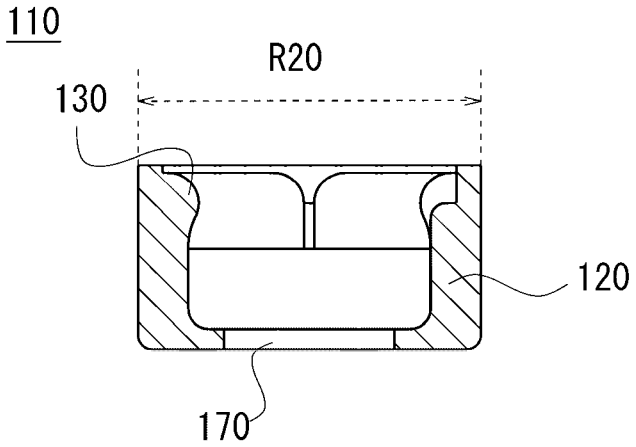

With reference to FIG. 17, a fourth embodiment will be described. FIG. 17 is a sectional view for illustrating a variation of a post holding member of a female snap button. Similar effects could be achieved as that of the above-described embodiments even when the respective post holding members shown in FIG. 17 are employed.

In the cases of FIGS. 17(*a*) and 17(*b*), the contact portion 140 is omitted, and the outer diameter R20 of the post holding member 110 is set to be perfectly or substantially identical to the inner diameter R10 of the surrounding wall 220 of the receiving member 210. Therefore, when the post holding member 110 is inserted and pressed into the receiving member 210, the outer circumferential surface of the post holding member 110 slides along the inner circumferential surface of the surrounding wall 220 of the receiving member 210. When the post holding member 110 is placed on the bottom portion 230 of the receiving member 210, the outer circumferential surface of the post holding member 110 touches (or is in intimate contact with (when more narrowly speaking)) the inner circumferential surface of the surrounding wall 220 of the receiving member 210. The inner circumferential surface of the surrounding wall 220 of the receiving member 210 is an even surface free of projections and recesses, thus the downward movement of the contact portion 140 may not extremely be hindered.

It may be appropriate to provide one or more grooves extending along the central axis AX at the outer circumferential surface of the post holding member 110 in order to reduce the drag force caused when the post holding member 110 is inserted into the receiving member 210.

The groove 180 shown in FIG. 17(*a*) and a cutout 190 shown in FIG. 17(*b*), in either cases, may ensure the radially outward displacement of the locking portion 130. As shown in FIG. 17(*a*), the groove 180 may be recessed at the upper surface of the tube 120 of the post holding member 110. As shown in FIG. 17(*b*), the cutout 190 may be provided so as to cut out the outer rim of the upper surface of the tube 120 of the post holding member 110.

In case shown in FIG. 17(*c*), the contact portion 140 is omitted, and the outer diameter R20 of the post holding member 110 is slightly narrower than the inner diameter R10 of the surrounding wall 220 of the receiving member 210. Therefore, after that the post holding member 110 has been inserted into the surrounding wall 220 of the receiving member 210, there may be a concern if the post holding member 110 may come off from the receiving member 210. This come-off of the post holding member 110 out of the receiving member 210 may be suppressed by appropriately setting a manufacturing process or manufacturing machine. After the fixing of the upper structure 310 to the texture 70 by the fixture 320, the shank of the fixture 320 pushes the post holding member 110 and the receiving member 210 toward the texture 70. Therefore, it is suppressed that the detachment of the post holding member 110 from the receiving member 210 will be a problem.

It should be noted that it is envisaged that the plastically deformed portion of the shank of the fixture 320 pushes only one of the post holding member 110 and the receiving member 210 toward the texture 70.

In view of the above teachings, the skilled person could add various modifications to the respective embodiments. The reference numbers introduced in Claims are just for a reference, and should not be relied upon for the purpose of narrowly construing claims. The hollow cylindrical shank and the cylindrical shank may be simply referred to as a shank comprehensively. In order to distinguish the bottom portion 150 and the bottom portion 230, the former may be referred as a first bottom portion and the latter may be referred to as a second bottom portion. This point holds true for the bottom holes either, and holds true for other identically named elements.

REFERENCE SIGNS LIST

110 Post holding member
120 Tube
130 Locking portion
140 Contact portion
150 Bottom portion
210 Receiving member
220 Surrounding wall
230 Bottom portion
240 Peripheral portion
250 Rim
260 Opening
300 Female snap button
310 Upper structure
320 Fixture

The invention claimed is:

1. An upper structure of a female snap button, the upper structure comprising:
- a post holding member that is configured to hold a post of a male snap button; and
- a receiving member that is configured to receive the post holding member, wherein
- the post holding member comprises:
  - a tube that extends along a central axis; and
  - one or more locking portions coupled to the tube and configured to lock the post, and wherein
- the receiving member comprises:
  - a surrounding wall that extends along the central axis so as to surround the post holding member;
  - a bottom portion that is coupled to a lower end of the surrounding wall and provided inward of the surrounding wall; and
  - a peripheral portion that is coupled to an upper end of the surrounding wall and provided outward of the surrounding wall, and wherein an opening is defined by a rim between the upper end of the surrounding wall and the peripheral portion,
- wherein a bottom portion of the post holding member is in contact with the bottom portion of the receiving member, and the bottom portion of the post holding member is coupled to a lower end of the tube and provided inward of the tube.

2. The upper structure according to claim 1, wherein the post holding member further comprises:
- one or more contact portions, each of which being projected from an outer circumferential surface of the tube so as to be in contact with an inner circumferential surface of the surrounding wall.

3. The upper structure according to claim 2, wherein a clearance exists between the tube and the surrounding wall when the post holding member is arranged inside of the receiving member.

4. The upper structure according to claim 2, wherein said one or more locking portions are provided at an upper end of the tube, and said one or more contact portions are provided at the lower end of the tube.

5. The upper structure according to claim 2, wherein a length of at least one of the contact portions along a circumferential direction around the central axis is less than a length of at least one of the locking portions along the circumferential direction.

6. The upper structure according to claim 2, wherein at least one of the contact portions comprises a sloped surface that allows easier insertion of the post holding member into the receiving member.

7. The upper structure according to claim 2 in which two or more of the locking portions are provided, wherein the post holding member further comprises a plurality of recesses each arranged between adjacent of the locking portions, wherein at least one of the contact portions is positioned radially outward of one of the recesses.

8. The upper structure according to claim 1, wherein
- a maximum length of the post holding member along the central axis is less than a depth along the central axis from the rim to the bottom portion of the receiving member.

9. The upper structure according to claim 1, wherein
- an outer circumferential surface of the tube touches an inner circumferential surface of the surrounding wall when the post holding member is arranged inside of the receiving member.

10. A female snap button comprising:

the upper structure according to claim 1; and a fixture for fixing the upper structure to a texture.

11. The female snap button according to claim 10 wherein when the post holding member is arranged inside of the receiving member, said bottom portion of the post holding member which is to be passed through by the fixture is placed on said bottom portion of the receiving member which is to be passed through by the fixture.

12. A method of attaching the upper structure of the female snap button of claim 1 to a texture or fabric using a fixture, the method comprising:

arranging the post holding member into the receiving member, the post holding member being inserted into the surrounding wall through the opening defined by the rim; and attaching the upper structure, in which the post holding member has been arranged inside of the receiving member, to the texture or the fabric by the fixture.

13. The method of claim 12, wherein the arranging includes pressing the post holding member into the receiving member through the opening.

14. The method of claim 12, wherein the post holding member further comprises:

the bottom portion that is coupled to the lower end of the tube and provided inward of the tube, and wherein the bottom portion of the post holding member is placed on the bottom portion of the receiving member, and wherein the upper structure is attached to the texture or the fabric by the fixture through a shank of the fixture passing through both of the bottom portion of the receiving member and the bottom portion of the post holding member.

15. The upper structure according claim 1, wherein the post holding member further comprises a plurality of contact portions arranged at constant angular interval with respect to the central axis so as to prevent the post holding member from being displaced relative to the receiving member.

16. The upper structure according to claim 15, wherein a length of at least one of the contact portions along a circumferential direction around the central axis is less than a length of at least one of the locking portions along the circumferential direction.

17. The upper structure according to claim 15, wherein at least one of the contact portions comprises a sloped surface that allows easier insertion of the post holding member into the receiving member.

18. The upper structure according to claim 15 in which two or more of the locking portions are provided, wherein the post holding member further comprises a plurality of recesses each arranged between adjacent of the locking portions, wherein at least one of the contact portions is positioned radially outward of one of the recesses.

19. An upper structure of a female snap button, comprising:

a post holding member that is configured to hold a post of a male snap button, the post holding member including:

a tube that extends along an axis that corresponds to a travel path of the male or the female snap button for engagement of the male and female snap buttons; and one or more locking portions coupled to the tube and configured to lock the post; and a receiving member that is configured to receive the post holding member, the receiving member including:

a surrounding wall that extends along the axis so as to surround the post holding member;

a bottom portion that is coupled to a lower end of the surrounding wall and provided inward of the surrounding wall;

a peripheral portion that is coupled to an upper end of the surrounding wall and provided outward of the surrounding wall; and a rim formed between the upper end of the surrounding wall and an inward end of the peripheral portion, wherein a bottom portion of the post holding member is in contact with the bottom portion of the receiving member, and the bottom portion of the post holding member is coupled to a lower end of the tube and provided inward of the tube.

* * * * *